US009140121B2

(12) United States Patent
Parrott

(10) Patent No.: US 9,140,121 B2
(45) Date of Patent: Sep. 22, 2015

(54) MINERAL CUTTER PICK ETC

(71) Applicant: Minnovation Limited, Wakefield (GB)

(72) Inventor: George Albert Parrott, Wakefield (GB)

(73) Assignee: Minnovation Limited, Wakefield (GB)

( * ) Notice: Subject to any disclaimer, the term of this patent is extended or adjusted under 35 U.S.C. 154(b) by 0 days.

(21) Appl. No.: 14/235,474

(22) PCT Filed: Nov. 5, 2012

(86) PCT No.: PCT/GB2012/000830
§ 371 (c)(1),
(2) Date: Jan. 28, 2014

(87) PCT Pub. No.: WO2013/068713
PCT Pub. Date: May 16, 2013

(65) Prior Publication Data

US 2014/0312678 A1 Oct. 23, 2014

(30) Foreign Application Priority Data

Nov. 11, 2011 (GB) ..... 1119486.7

(51) Int. Cl.
*E21C 35/187* (2006.01)
*B05B 15/06* (2006.01)
(Continued)

(52) U.S. Cl.
CPC ..... *E21C 35/187* (2013.01); *B05B 15/065* (2013.01); *E21C 35/19* (2013.01); *E21C 2035/1826* (2013.01)

(58) Field of Classification Search
CPC ..... E21C 35/187; E21C 35/19; E21C 2035/1826; E21C 35/23; B05B 15/065; E21B 41/0078
USPC ..... 299/81.1, 81.2, 81.3, 102, 107; 175/339, 340, 429, 424
See application file for complete search history.

(56) References Cited

U.S. PATENT DOCUMENTS 2,844,378 A 7/1958 Whistler et al.
4,536,037 A 8/1985 Rink
(Continued)

FOREIGN PATENT DOCUMENTS

DE 2937380 A1 4/1981
EP 0587991 A2 3/1994
(Continued)

OTHER PUBLICATIONS

European Patent Office, International Search Report in corresponding PCT/GB2012/000830, Nov. 26, 2013, 4 pages.

*Primary Examiner* — John Kreck
*Assistant Examiner* — Carib Oquendo
(74) *Attorney, Agent, or Firm* — Hooker & Habib, P.C.

(57) ABSTRACT

A water spray system particularly, but no exclusively, for mineral mining, comprising a pick (1) having an integral shank (4) by which it is releasably receivable in an aperture (17) of a block (16), a heel (7) extending rearwardly from the pick (1), a hole (9) passing through the heel (7) and a pair of spaced-apart cheeks extending beyond the hole, a spray nozzle (24) received in a bore (22) of the block (16) with a head (25) of the nozzle projection above an upper surface of the block (16) to a location between the cheeks (8), with a water discharge orifice of the head (25) so located beneath the heel (7) and with respect to the through hole (9) of the heel (7) that water discharged from the orifice into the through hole and exiting the through hole induces an air flow wholly or partially through the through hole. Other aspects of the invention are the pick (1), the block (6), a releasable latching system, and a drivable member.

20 Claims, 2 Drawing Sheets

(51) Int. Cl.
*E21C 35/19* (2006.01)
*E21C 35/18* (2006.01)

(56) References Cited

U.S. PATENT DOCUMENTS

| | | | | |
|---|---|---|---|---|
| 4,657,308 | A * | 4/1987 | Clapham | 299/81.1 |
| 5,071,195 | A | 12/1991 | Komotzki | |
| 5,195,805 | A | 3/1993 | Clapham | |
| 6,257,672 | B1 * | 7/2001 | Parrott | 299/81.3 |
| 6,764,141 | B2 * | 7/2004 | O'Neill | 299/81.3 |
| 2004/0119327 | A1 | 6/2004 | O'Neill | |

FOREIGN PATENT DOCUMENTS

| | | | |
|---|---|---|---|
| GB | 2141765 | A | 1/1985 |
| GB | 2167789 | A | 6/1986 |
| GB | 2250455 | A | 6/1992 |
| GB | 2396366 | A | 6/2004 |
| WO | 2013113062 | A1 | 8/2013 |

* cited by examiner

MINERAL CUTTER PICK ETC

FIELD OF THE INVENTION

This invention relates to a mineral cutter pick, to a block for releasably retaining a shank of a pick, a pick to block latching system and to a water spray system for use with such pick and block.

BACKGROUND OF THE INVENTION

Mineral cutter picks etc are used extensively not only for mineral winning, in particular coal mining, but also for the driving of underground roadways or tunnels, or for civil engineering purposes, such as road planing, as part of road resurfacing operations, or trench cutting operations.

In practice, a series of blocks are attached e.g. by welding, around a drum, helical vane, or end face plate if a so-called shearer drum is involved, or attachment may be to an endless chain, each block having an aperture of profile matching that of a pick shank to be located in the aperture.

If coal mining is involved, the displacement of air to the area of the cut has long been recognised as advantageous in diluting methane released during mining. One proposal for achieving this development in the UK some decades ago, was to construct a shearer drum with a hollow annulus in which was located an array of water sprays to induce an air flow from the goaf or gob side to the face side of the drum.

One known water spray system is described in GB 2250455, where basically the pick is provided with a through hole in a rearwardly directed heel, and the head of a water spray nozzle, which is releasably retained within a bore of a block, projects above the block into the through hole, whereby the head of the nozzle, and its water discharge orifice are protected from damage and debris by the heel, so long as the pick remains intact and in situ.

It is not uncommon however for picks to be lost or broken for a variety of reasons. Sometimes, the retention system between pick shank and block fails. Sometimes, particularly during mineral winning operations, the picks inadvertently strike metal roof supports and are broken off. Such events lead to exposure, or potential exposure of the nozzle head, which eventually is wiped off upon continuation of mining operations.

One known staple latching system for a pick is described in U.S. Pat. No. 3,268,260. The staple was insertable, and removable in a horizontal plane, and the provision of a circumferential groove in the outer periphery of the shank introduces a zone of weakness.

OBJECT OF THE INVENTION

A basic object of the present invention is the provision of an improved spray system, pick, block, combination of pick and block, and a drivable member.

Summary of a First Aspect of the Invention

According to a first aspect of the invention, there is provided a water spray system particularly, but no exclusively, for mineral mining, comprising a pick having an integral shank by which it is releasably receivable in an aperture of a block, a heel extending rearwardly from the pick, a hole passing through the heel and a pair of spaced-apart cheeks extending beyond the hole, a spray nozzle received in a bore of the block with a head of the nozzle projection above an upper surface of the block to a location between the cheeks, with a water discharge orifice of the head so located beneath the heel and with respect to the through hole of the heel that water discharged from the orifice into the through hole and exiting the through hole induces an air flow wholly or partially through the through hole.

Summary of a Second Aspect of the Invention

According to a second aspect of the invention, of independent significance, there is provided a mineral cutter pick for use with the water spray system of the first aspect, comprising:

(i) an elongate shank by which the pick is releasably retainable within a recessed aperture of a block, which shank has a longitudinal axis;
(ii) an enlarged head integrated in the shank;
(iii) a heel projecting from the rear of the head;
(iv) a through hole in the heel; and
(v) a pair of spaced-apart cheeks extending from the heel one at each lateral side of the through hole with the latter having an axis that is upwardly inclined, and that if projected, intersects a projection of the longitudinal axis of the shank.

Summary of a Third Aspect of the Invention

According to a third aspect of the invention, of independent significance, there is provided a block for releasably receiving the shank of a mineral cutter pick, in accordance with the second aspect, the block comprising:

(i) a body member;
(ii) a circular section aperture in the body member of profile matching that of a shank of a pick to be releasably retained by the block; and
(iii) a groove in what, in use, is an upper face of the block in which groove a portion of a pick is adapted to seat to fix the orientation of the pick.

Summary of a Fourth Aspect of the Invention

According to a fourth aspect of the invention, of independent significance, there is provided, in combination, a pick in accordance with the second aspect and a block in accordance with the third aspect, with a shank of the pick engaged in the receiving aperture of the block.

Summary of a Fifth Aspect of the Invention

According to a fifth aspect of the invention, of independent significance, there is provided a releasable latching system to retain an elongate pick shank within a receiving aperture of a block, comprising:

(i) a pick shank provided with two spaced-apart through holes, each passing through the longitudinal axis of the shank;
(ii) a block having a receiving aperture of profile corresponding to that of the shank to be inserted into the aperture, a pair of transverse holes passing through the block and spaced apart by the same distance as the holes of the shank, such that the holes are coaxial following insertion of a pick shank; and
(iii) a U-shaped, insertable and removable staple, the limbs of which are locatable one in each of the coaxial holes of the block and shank.

Summary of a Sixth Aspect of the Invention

According to a sixth aspect of the invention, of independent significance, there is provided a drivable member, such as a rotary drum or endless chain, provided with a plurality of blocks in accordance with the second aspect.

Advantages of the Various Aspects of the Invention

The emission of a spray of water, into, along and eventually from, the through hole of the heel induces an air flow, which is beneficial firstly in the creation of finer water droplets to suppress or control any propensity for incendive sparking or ignition in a zone immediately behind the pick head, and secondly for the dilution of methane, if coal mining is involved. In addition, after insertion of a pick into a block the pair of spaced-apart cheeks serve to embrace and protect the otherwise exposed head of a spray nozzle.

Preferred or Optional Features

The Pick

The pick is provided with a circular section shank.

The shank is provided with at least one formation, such as a recess, circumferential groove, or diametral through hole, for the passage of a limb of an insertable and removable metallic retaining pin.

The shank is provided with two diametral through holes, spaced apart along the longitudinal axis of the shank and thus being on the centre line and neutral axis of the shank thereby avoiding the inherent weakening of a shank by prior art circumferential grooves etc.

The pick, at a zone of intersection between its head and its shank, is provided at each lateral side with an arcuate seating extension.

The arcuate seating extensions are provided with a concave seating surface.

The projected axis of the through hole, intersects the projected longitudinal axis of the shank at 40° to 60°, or thereabouts and preferably 50°, or thereabouts.

The pick is provided with a carbide tip.

The Block

The shank receiving aperture terminates, at its upper end, in a convex seating surface matching the concave seating surface of a pick.

The block is provided with a bore to receive a body portion of a replaceable spray nozzle.

The replaceable spray nozzle and its receiving bore in the block is/are provided with a latching or retaining device.

The latching or retaining device is a metal pin adapted to be pushed or knocked into or out of a transverse bore, with the body portion of the replaceable spray nozzle provided with a circumferential groove for engagement by a portion of the latching pin.

The block is provided with at least one transverse bore, adapted to be aligned coaxially with a bore of an inserted shank of a pick.

A metallic pin is adapted to be pushed or knocked into or out of the bores, to latch the pick shank into its receiving aperture in the block.

Two spaced-apart parallel transverse bores, one above the other, are provided in the block for use with a two-armed, partly "U"-shaped latching pin, such that the arms of the pin are deployed in a common, vertical plane.

BRIEF DESCRIPTION OF THE DRAWINGS

The accompanying drawings, shown, by way of example only.

DETAILED DESCRIPTION OF THE DRAWINGS

Figure 2:
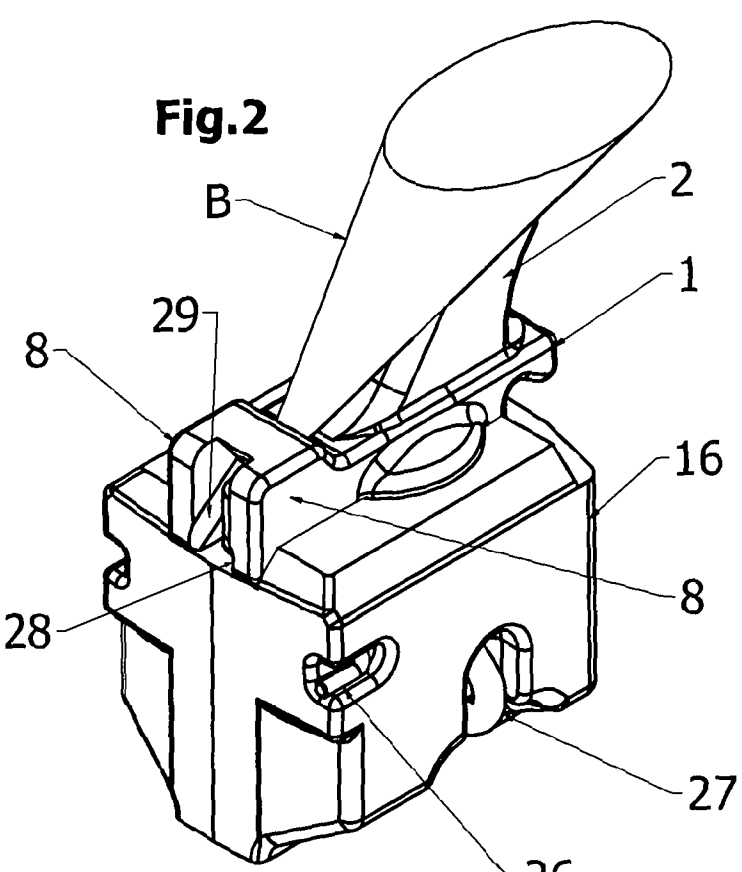
FIG. 2 corresponds to FIG. 1 but from the other side.
Figure 1:
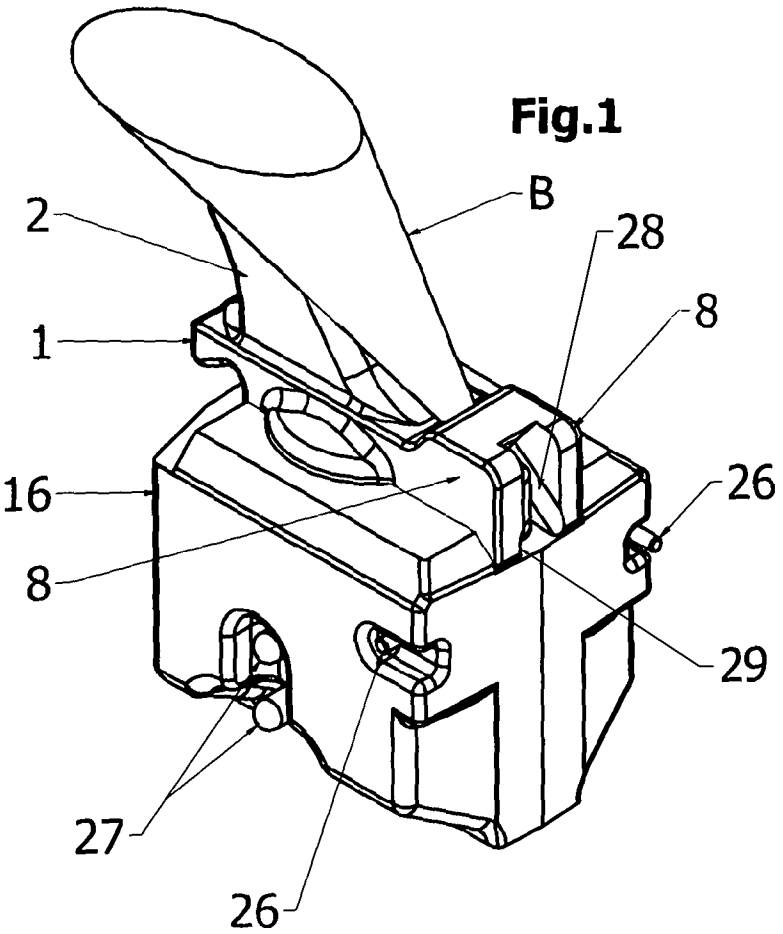
FIG. 1 is a perspective view from the rear, one side and from above, of a pick in accordance with the second aspect inserted into a block in accordance with the third aspect to define a combination in accordance with the fourth aspect and constituting the water spray system of the first aspect.

A pick 1 comprises a head 2 (sometimes referred to as a blade) provided with a carbide tip 3, and having an integral shank 4 of circular section, itself having a longitudinal axis 5, and being provided with two, axially spaced-apart, diametrical through holes 6.

Figure 3:
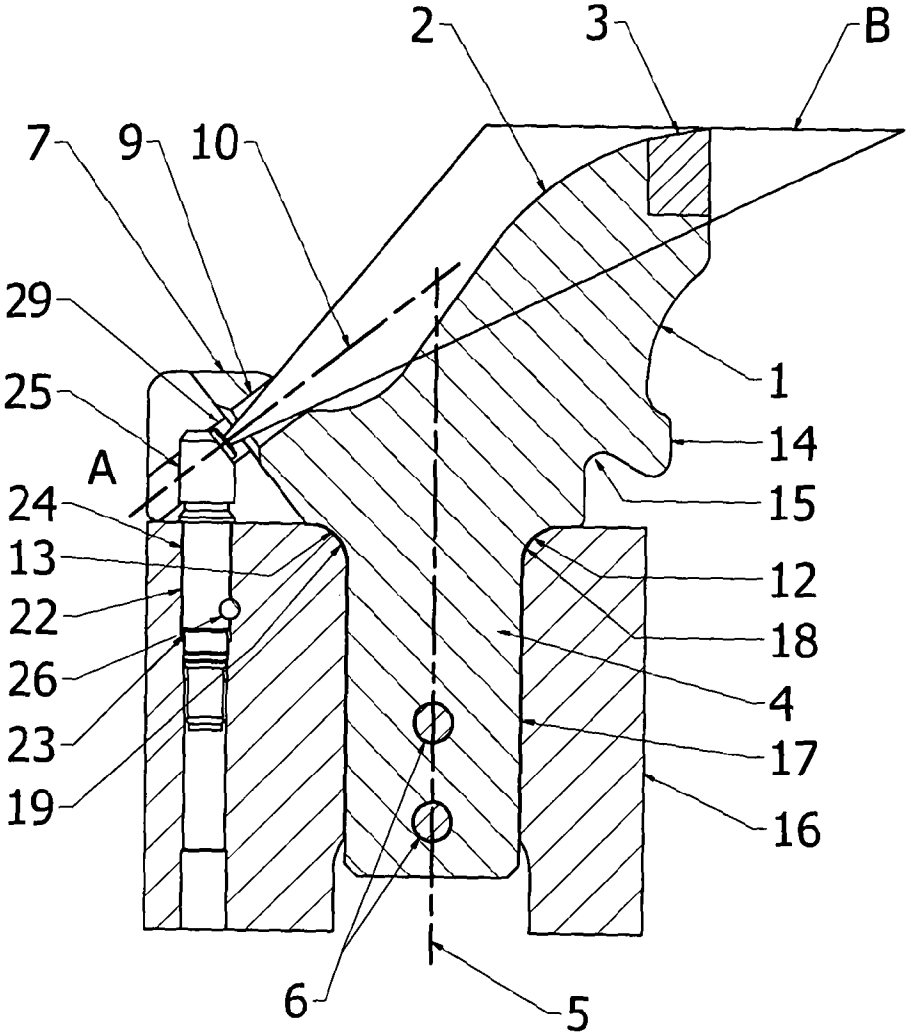
FIG. 3 is a longitudinal sectional view through FIG. 1 or FIG. 2.

A heel 7 projects from a rear of the pick 1 and comprises a pair of paralleled and spaced-apart, cheeks 8. The heel 7 has a through hole 9 located between the cheeks and having an axis 10 that is upwardly inclined and as indicated in FIG. 3, intersects the longitudinal axis 5 of the shank 4. At each lateral side, the pick 1 is provided with concave seating surfaces 11, in addition to forward and rearward planar and concave seating surfaces 12 and 13. The head 2 is also provided with a nose 14 to define a recess 15 into which the end of a lever or drift may be inserted to aid removal of a pick when pick changing is required.

A block 16, adapted to be welded to the periphery of a rotary mineral winning or cutting drum or to a cutter chain, is provided with a circular section aperture 17 in the form of a through hole of diameter corresponding to that of the shank 4, with tolerances such that a pick 1 may be manually inserted and removed from a block 16 with relative ease when pick changing is required.

The block 16 is provided with forward and rearward planar and convex seating surfaces 18,19 to match the surfaces 12 and 13 of a pick 1 and also with convex lateral surfaces 20 to match the surfaces 11 of a pick 1. The block 16 is also provided with a pair of transversely extending, parallel through holes 21, one located above the other in the same vertical plane, and adapted to be coaxial with the holes 6 of the shank 4 of an inserted pick 1.

The block 16 is also provided with a bore 22, parallel to the through hole 17, and adapted to receive a body portion 23 of a spray nozzle 24, having a head 25 projecting above an upper surface of the block 16 into a zone between the cheeks 8 of an inserted pick 1. The nozzle 24 is releasably latched in the bore 22 by a metallic pin 26 engaging a recess or circumferential groove in the external periphery of the nozzle 24 and also engaging a semicircular channel in the bore 22, such that a discharge orifice of the nozzle 24 is located on, or in the vicinity of, the axis 10 of the through hole 9.

Figure 4:
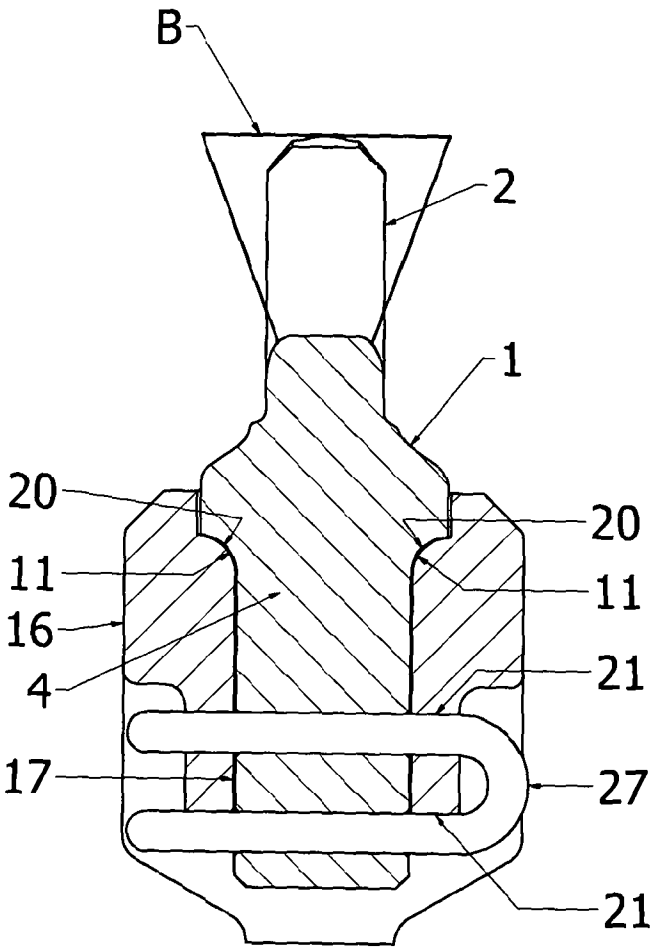
FIG. 4 is a transverse sectional view through FIG. 1 and FIG. 2.

As best seen in FIGS. 3 and 4, a U-shaped wire pin 27 is pushed or knocked into the aligned holes 6 and 21 to latch a pick 1 into a block 16, with the base of the "U" being engageable by a lever, a screwdriver blade etc to withdraw the pin 26 laterally from the latching position illustrated in FIGS. 3 and 4, so that a worn or damaged pick 1 may be removed from its block 16.

The cheeks 8 cooperate to define facing walls that define a gap between them that is open to the ambient environment. Formed on each of the facing walls is a respective groove 28, 29 that extends from the heel 7 to the end of the wall away from the heel 7. As best seen in FIG. 3, each groove 28, 29 extends along and parallel to the hole axis 10 and faces the spray nozzle head 25 to better enable ambient air drawn in from the ambient environment at A to flow around the spray nozzle head 25 and into the hole 9.

As indicated in all four Figures, the emission of a water spray from the discharge orifice of the nozzle 24 results in an induced air flow from an area A to the rear of the block 16, into one end and out of the other end of the hole 9, as well as the creation of fine water droplets, to define a conical area B principally to the rear of the head 2 serving not only for dust suppression and incendive sparking elimination, but also methane dilution, if coal mining is involved.

The invention claimed is:

1. A cutter pick assembly comprising:

a cutter pick and a block;

the cutter pick comprising a head adapted to hold a cutter bit, a shank extending in a longitudinal direction away from the head, and a heel extending away from the head transverse to the longitudinal direction, the heel comprising first and second sides separated by a thickness of the heel and a through-hole extending through the thickness of the heel, the through-hole having an intake end at the first side of the heel and a discharge end at the second side of the heel;

the block comprising an aperture, a spray nozzle, and an outer surface, the aperture capable of receiving the shank and placing the cutter pick in an operating position when the shank is received in the aperture, the spray nozzle comprising an inlet for receiving water and a discharge orifice for discharge of water from the spray nozzle, the spray nozzle extending from the block away from the outer surface and locating the discharge orifice outside of the block;

when the cutter pick is in the operating position:

a pair of cheeks extend from the first side of the heel away from the heel, the pair of cheeks being spaced apart from one another and defining a gap therebetween;

the through-hole is disposed between the cheeks with the intake end of the through-hole facing the gap;

the spray nozzle is between the cheeks with the discharge orifice in the gap, the discharge orifice being configured to spray water discharged from the nozzle through the through-hole; and the outer surface of the block is adjacent the cheeks and extends between the cheeks, the outer surface and the cheeks defining a channel extending to the intake side of the through-hole, the channel being in fluid communication with the ambient environment.

2. The cutter pick assembly of claim 1 wherein when the cutter pick is in the operating position, each cheek extends from a first end of such cheek at the heel, past the spray nozzle, to a second end of such cheek spaced from the spray nozzle.

3. The cutter pick assembly of claim 1 wherein the through-hole extends along a first axis and the shank extends along a second axis, the first and second axes defining an included angle therebetween of between about 40 degrees and about 60 degrees.

4. The cutter pick assembly of claim 1 wherein the through-hole extends along a first axis and the shank extends along a second axis, the first and second axes intersecting one another.

5. The cutter pick assembly of claim 4 wherein the cutter pick is spaced away from the intersection of the first and second axes.

6. The cutter pick assembly of claim 1 wherein the spray nozzle is configured to spray water on the cutter bit held by the head when the cutter pick is in the operating position.

7. The cutter pick assembly of claim 1 wherein the spray nozzle comprises a spray head disposed outside of the block, the discharge orifice in the spray head, the spray head in the gap when the cutter pick is in the operating position; and one cheek of said pair of cheeks comprises a side facing the gap and a groove formed in the side, the groove extending from the heel and past the spray head when the cutter pick is in the operating position.

8. The cutter pick assembly of claim 7 wherein the other cheek comprises a side facing the gap and a groove formed in the side, the groove extending from the heel and past the spray head when the cutter pick is in the operating position.

9. The cutter pick assembly of claim 7 wherein the gap extends from a first end to a second end of the one cheek, the groove extending from the first end to the second end of the one cheek.

10. The cutter pick assembly of claim 1 wherein the shank extends along a shank axis;

the intake end of the spray nozzle is disposed in a bore of the block, the bore extending along a bore axis; and the bore axis is parallel with the shank axis when the cutter pick is in the operating position.

11. The cutter pick assembly of claim 1 wherein the channel defined by the cheeks and outer surface of the block extends from a first end at the heel to a second end away from the heel when the cutter pick is in the operating position, the spray nozzle spaced away from the second end of the channel when the cutter pick is in the operating position.

12. The cutter pick assembly of claim 1 wherein the cheeks extend away from the block to an open side of the channel when the cutter pick is in the operating position.

13. The cutter pick assembly of claim 1 wherein the intake end of the spray nozzle is disposed in a bore of the block, the bore extending along a bore axis;

the discharge orifice of the spray nozzle is configured to discharge water extending along a discharge axis away from the discharge orifice; and the discharge axis and the bore axis define an included angle therebetween of between about 40 degrees and about 60 degrees.

14. A cutter pick assembly comprising:

a cutter pick and a block;

the cutter pick comprising a head adapted to hold a cutter bit, a shank extending in a longitudinal direction away from the head, and a heel extending away from the head transverse to the longitudinal direction, the heel comprising first and second sides separated by a thickness of the heel and a through-hole extending through the thickness of the heel, the through-hole being bounded by a solid annular wall extending from the first side to the second side of the heel, the through-hole having an intake end at the first side of the heel and a discharge end at the second side of the heel;

the block comprising an aperture, a spray nozzle, and an outer surface, the aperture capable of receiving the shank and placing the cutter pick in an operating position when the shank is received in the aperture, the spray nozzle comprising an inlet for receiving water and a discharge orifice for discharge of water from the spray nozzle, the spray nozzle extending from the block away from the outer surface and locating the discharge orifice outside of the block;

when the cutter pick is in the operating position:

a pair of cheeks extend from the first side of the heel away from the heel, the pair of cheeks being spaced apart from one another and defining a gap therebetween;

the through-hole is disposed between the cheeks with the intake end of the through-hole facing the gap;

the spray nozzle is between the cheeks with the discharge orifice in the gap, the discharge orifice being configured to spray water discharged from the nozzle through the through-hole; and the outer surface of the block is adjacent the cheeks and extends between the cheeks, the outer surface and the cheeks defining a channel extending to the intake side of the through-hole, the channel being in fluid communication with the ambient environment.

15. The cutter pick assembly of claim 14 wherein the through-hole extends along a first axis and the shank extends along a second axis, the first and second axes defining an included angle therebetween of between about 40 degrees and about 60 degrees.

16. The cutter pick assembly of claim 14 wherein one of or both of the pair of cheeks comprise a side facing the gap and a groove formed in the side, the groove extending from the heel and past the spray nozzle when the cutter pick is in the operating position.

17. The cutter pick assembly of claim 16 wherein the through-hole extends along a bore axis from the first side of the heel to the second side of the heel, each groove extending along the bore axis when the cutter pick is in the operating position.

18. A cutter pick assembly capable of generating a water spray that draws air from the ambient environment into the spray, the assembly comprising:

a cutter pick and a block;

the cutter pick comprising a head adapted to hold a cutter bit, a shank extending in a longitudinal direction away from the head, and a pair of cheeks;

a heel extending away from the head transverse to the longitudinal direction, the heel comprising first and second sides separated by a thickness of the heel and a through-hole extending through the thickness of the heel, the through-hole having an intake end at the first side of the heel and a discharge end at the second side of the heel;

the pair of cheeks extending from the first side of the heel away from the heel, the pair of cheeks being spaced apart from one another and defining a gap therebetween, the through-hole being disposed between the cheeks with the intake end of the through-hole facing the gap;

the block comprising an aperture, a spray nozzle, and an outer surface, the aperture capable of receiving the shank and placing the cutter pick in an operating position when the shank is received in the aperture, the spray nozzle comprising an inlet for receiving water and a discharge orifice for discharge of water from the spray nozzle, the spray nozzle extending from the block away from the outer surface and locating the discharge orifice outside of the block;

when the cutter pick is in the operating position:

the spray nozzle is between the cheeks with the discharge orifice in the gap, the discharge orifice being configured to spray water discharged from the nozzle through the through-hole; and the outer surface of the block is adjacent the cheeks and extends between the cheeks, the outer surface and the cheeks defining a channel extending to the intake side of the through-hole, the channel being in fluid communication with the ambient environment.

19. The cutter pick assembly of claim 18 wherein the through-hole extends along a bore axis from the first side of the heel to the second side of the heel, each groove extending along the bore axis.

20. The cutter pick assembly of claim 18 wherein each cheek comprises a side facing the other cheek, one of or both of the pair of cheeks comprise a groove formed in the side, the groove extending from the heel to a distal end of the cheek.

* * * * *